US006052851A

United States Patent [19]

Kohnle

[11] Patent Number: 6,052,851

[45] Date of Patent: Apr. 25, 2000

[54] MATTRESS FOR MINIMIZING DECUBITUS ULCERS

[76] Inventor: Robert C. Kohnle, 11533 SW. Pacific Hwy., Tigard, Oreg. 97223

[21] Appl. No.: 08/823,720

[22] Filed: Mar. 25, 1997

Related U.S. Application Data

[63] Continuation of application No. 08/598,350, Feb. 8, 1996, abandoned.

[51] Int. Cl.[7] ..... A47C 27/15

[52] U.S. Cl. ..... 5/690; 5/736; 5/740; 5/691; 5/901

[58] Field of Search ..... 5/464, 468, 481, 5/900.5, 901, 903, 690, 691, 736, 740

[56] References Cited

U.S. PATENT DOCUMENTS

| | | | |
|---|---|---|---|
| 3,051,601 | 8/1962 | Schick | 5/464 |
| 4,972,535 | 11/1990 | Goldman | 5/464 |
| 5,022,111 | 6/1991 | Fenner | 5/464 |
| 5,077,849 | 1/1992 | Farley | 5/464 |
| 5,141,285 | 8/1992 | Park | 297/457 |
| 5,317,768 | 6/1994 | Klancnik | 5/464 |
| 5,488,746 | 2/1996 | Hudson | 5/903 |

OTHER PUBLICATIONS

Alimed, Orthopedic Rehabilitation 1993–94 297 High Street, Dedham, MA 02026–9135 M230 and M248.

Human Factors in Effective Seating Design By Brian Joyal E–A–R Specialty Composites Division, Cabot Safety Corporation 7911 Zionsville Road Indianapolis, IN 46268.

New York Times Magazine, Nov. 5, 1995, p. 33 Brookstone Tempur–Pedic 1655 Bassford Drive, Mexico, MO 65265–13382.

*Primary Examiner*—Rodney M. Lindsey
*Assistant Examiner*—Fredrick Conley
*Attorney, Agent, or Firm*—Marger, Johnson, McCollom & Stolowitz, P.C.

[57] ABSTRACT

A mattress which increases the surface area contacting the patient's skin, and which conforms evenly to the skin over the skin/surface interface. A mattress includes a flat layer of foam that is temperature sensitive and which has rate-dependent deflection which provides maximal hysteric dampening and maximal tissue/surface interface contact. Different stiffnesses of foam are used under key areas to allow support and at the same time to allow the tissue to reach mechanical equilibrium. The maximal surface contact will apply constant low pressure to the tissues, thus reducing the shear force and the risk of tissue injury.

3 Claims, 1 Drawing Sheet

MATTRESS FOR MINIMIZING DECUBITUS ULCERS

This is a Continuation of application Ser. No. 08/598,350 filed Feb. 8, 1996, now abandoned.

BACKGROUND OF THE INVENTION

This invention is related to the decubitus ulcer disease, and in particular to an improved mattress for reducing the occurrence of decubitus ulcer disease.

Decubitus ulcer disease (pressure sores) is a secondary condition which frequently occurs in elderly patients, and others whose mobility is limited. Pressure sores are a growing problem for patients, and for health care providers. Twenty percent of all patients admitted to long-term care facilities arrive with pressure sores. An additional 12% develop new sores over each subsequent six-month period. 1.7 million patients developed bed sores in 1993. The cost to treat bed sores was estimated at $8.5 billion in 1993. The number of patients requiring treatment for bed sores, and the associated costs, can be expected to increase in the coming years as the number of persons over 50 years of age increases. The persistent and increasing problem of pressure sores has prompted investigation into their causes.

Kosiak, who is referred to as the father of modern pressure sore research, defined pressure sores as localized areas of cellular necrosis. From his studies with dogs, he concluded that ischemia resulting from supracapillary pressures was one of the main causes of ulceration. Pressure ulcers were the result of ischemic, neurophic, and metabolic factors. Ulcers almost always occur in the tissue that overrides a bony prominence. When pressure exceeds tissue capillary pressure, ischemic changes result in ulceration.

Kosiak found that very high pressure over a short period of time was just as dangerous for developing ulcers as lower pressure over a longer period of time. 70 mmHg over two hours caused pathologic changes in the tissues of dogs, while 500 mmHg for two hours caused pressure sores. Kosiak's work showed that degeneration of the tissue occurs simultaneously at all levels, including the skin.

In 1930 Eugene M. Landis published a report on the Micro-Injection method for determining the blood pressure in capillaries. The method consists essentially of cannulating single capillary loops by means of a micropipette immediately adjacent to the edge of the cuticle of health individuals. 125 people were tested at the arteriolar limb, which showed a range of 21–43 mmHg with an average pressure of 32 mmHg. Nineteen people were tested at the summit of the loop, which showed a range of 18 to 32 mmHg with an average of 20 mmHg. Ninety nine people were tested at the venous limb, which show a range of 6–18 mmHg with an average of 12.3 mm Hg.

Landis further tested these individuals to determine how the capillaries would respond under stress. Stress was introduced by five methods: 1) venous congestion and capillary pressure; 2) hyperemia of heat; 3) capillary pressure in the histamine flare; 4) capillary pressure during local cooling of the skin; 5) capillary pressure after injury of the skin. Capillary response to the stresses was a uniformed increase of pressure to combat the stress, which is better known today as a compensatory response. Landis concluded that human capillary pressure varies through much wider limits than had been previously supposed. These measurements became the reference points for later research in capillary occlusion, secondary to pressure.

Disdale used pigs to study the effects of friction on the tissue and their role in the development of pressure sores. He found that friction increased the susceptibility to the skin ulceration at a constant pressure of less than 500 mm Hg but that friction and repetitive pressure of only 45 mm Hg also resulted in skin ulceration. He found that decubitus ulcers were not totally the result of an ischemic mechanism but that friction was a factor in the pathogenesis of ulcerations because it applies mechanical forces in the tissues.

Research by Keane supported the fact that ischemic muscle necrosis, due to pressure, occurs before skin death. This finding was further supported by the research of Daniel, Priest, and Wheatley. These investigators found that the pathological changes were initially in the muscle, which then progressed toward the skin with increased pressure and/or prolonged duration.

Vistnes used pigs to study the pressure gradients from the bony surfaces within the tissue out to the surface of the skin. He believed that the highest pressure was located at the bony surface and that all ulcers started at the bone and worked out. A force exerted on a small-area internal bony prominence will produce a large pressure near the bone, while the same force transmitted to the larger area of the underlying skin with produce a smaller pressure.

Czerniecki studied the effects of increased skin loading on local circulation over both soft tissue and bone in humans. Three groups were studied: young, healthy populations; older healthy populations; and peripheral vascular disease populations. Transcutaneous oxygen tension was measured while pressure was applied to the electrode. Measurements were done on the amount of pressure applied, the amount of tissue displacement that took place, and the oxygen tension when local circulation was reduced to zero.

The work of all these researchers supports the conclusion that the subcutaneous tissue pressure is related to both the magnitude and direction of the externally applied load, and to the mechanical characteristics of the tissue. Therefore, when studying the effect of loads on tissue perfusion, it is desirable to measure both the applied load and the mechanical characteristics of the tissue.

As a result of this considerable body of research, it has been found that the primary factors associated with the occurrence of pressure sores are high, localized skin pressure, and friction forces on the skin. Skin pressure above a certain level impedes micro-circulation through the subcutaneous capillaries, and thereby impedes the flow of oxygen and nutrients to skin tissues. If the high skin pressure is not relieved, the skin break will down and pressure sores will develop, opening the body to infection.

Krouskop has researched the development of interfacing surfaces to reduce tissue stress in both sitting and lying positions. He evaluated the factors affecting the pressure-distributing properties of foam mattress overlays. He reported that mattresses support the human body through either the development of mechanical equilibrium between the body of given total weight or by resistance to deformation increasing with the depth of penetration of the supported body. Although the weight of the body deforming a mattress or overlay is constant, the applied pressure at the body/mattress interface changes with increasing area of contact. For this reason, minimum average pressure is achieved with maximum envelopment of the body by the mattress. Krouskop went on to compare different types of foams by use of a spherically shaped indentor to evaluate the load-bearing capacity of the foam and then compares these pressures to pressures generated in clinical settings. Krouskop understood that pressures can be reduced by increasing surface area contact, and arrived at 32 mmHg as the maximum permissible pressure. Until now, it has been thought that the incidence and severity of pressure sores can only be reduced if high skin pressures of 32 mmHg are avoided.

As a result, there remains a need for an improved interfacing material which can be readily adapted for use on a conventional bed, and which can effectively reduce the occurrence of pressure sores.

SUMMARY OF THE INVENTION

Applicant has discovered that contrary to the teachings of the prior art, increased surface area contact will permit the tissues to withstand higher contact pressures than previously thought, so long as the supporting force is equally applied to the body tissues in contact with the mattress. Up until now, however, there has not been a suitable mattress or mattress cover formed from a solid interfacing material which can effectively maximize the contact surface area, and thereby minimize the occurrence of bedsores. Mattresses comprising egg crate foam overlayed atop a mattress relieve skin pressure on portions of the patient's skin, but not at all points on the patient's body sufficiently to prevent capillary occlusion. Mattresses overlain with egg crate materials may, in fact, cause higher localized skin pressures, since the patient's weight is being supported on a reduced overall surface area.

The present invention is embodied in a mattress, or a mattress pad, which increases the surface area contacting the patient's skin, and which conforms evenly to the skin over the skin/surface interface. Specifically, a mattress according to the present invention comprises a flat layer of foam that is temperature sensitive and the deflection is which is rate dependent, i.e., the mattress resistance to deformation decreases with increased depth, thus allowing maximal hysteric dampening and maximal tissue/surface interface contact. Different stiffnesses of foam are used under key areas to allow support, which at the same time will allow the tissue to reach mechanical equilibrium. The maximal surface contact will apply constant low pressure to the tissues, thus reducing the shear force and the risk of tissue injury. A convoluted foam piece is placed under the entire length and width of the solid temperature sensitive foam to allow maximal load displacement which will assist in total tissue/surface contact. These and other features of the invention will be discussed with reference to the drawings.

DETAILED DESCRIPTION OF THE INVENTION

Figure 1:
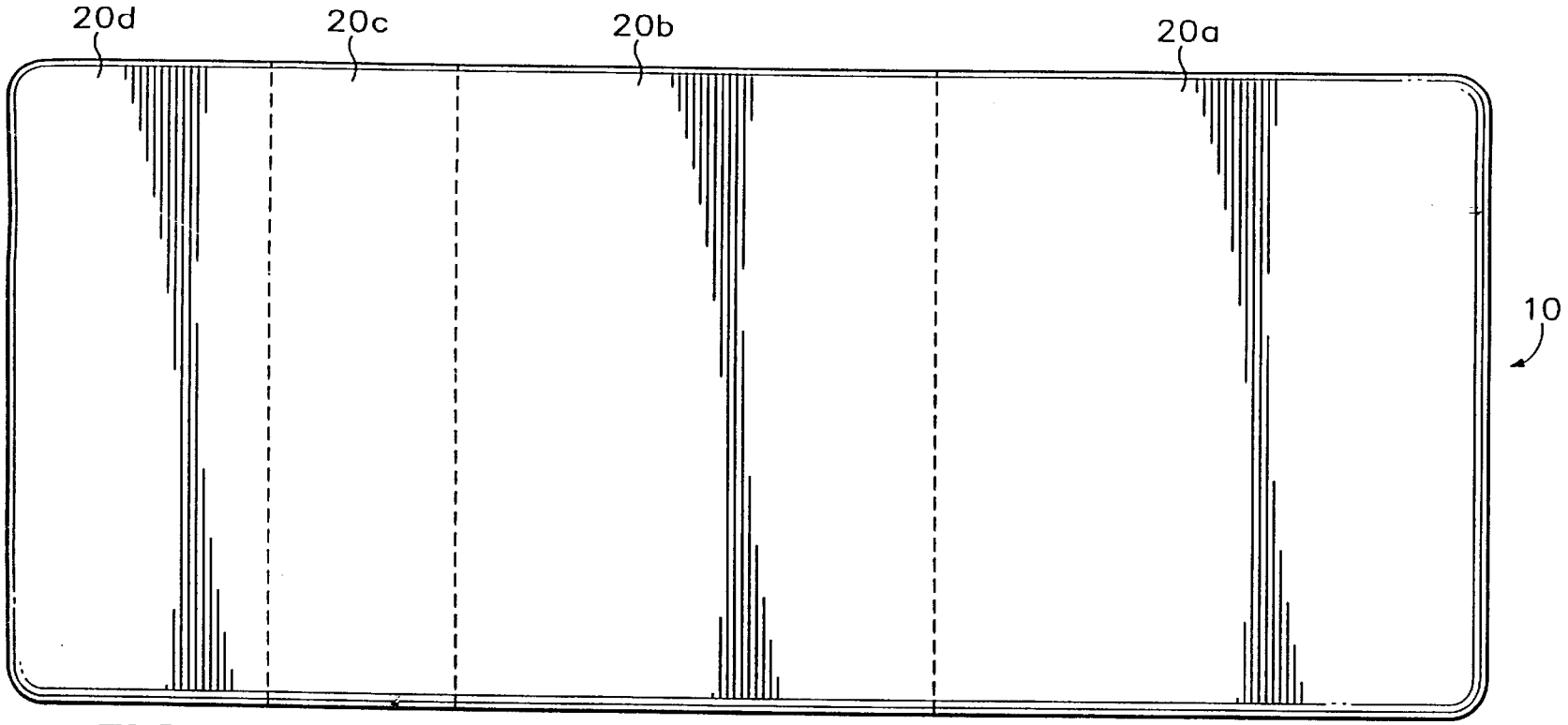
FIG. 1 is a cross-sectional view of a mattress according to the present invention.
Figure 2:
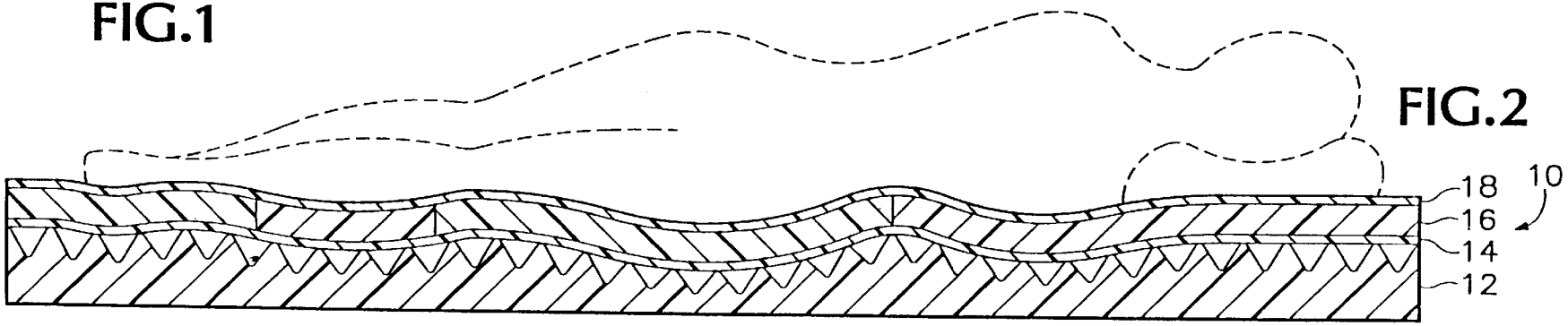
FIG. 2 is a plan schematic view of the temperature sensitive foam layer in a mattress according to the present invention.

Turning now to FIGS. 1 and 2, a mattress according to the present invention is shown generally at 10. Mattress 10 includes convoluted foam layer 12, a first abrasion resistant layer 14, a conforming layer 16, and a second abrasion resistant layer 18. Layer 12 is preferably an egg crate foam, four inches thick, and made of polyfoam. Other types, materials and thicknesses of convoluted foam could be substituted for layer 12. Abrasion resistant layers 16 and 18, which are used to protect conforming layer 16, are preferably one-fourth inch thick nylon foam, although, as with layer 12, other foam materials with acceptable abrasion resistant properties could be substituted.

Conforming layer 16 is preferably formed from an open cell, temperature softening, urethane foam, such as that sold as CONFORM® by EAR Specialty Composites Corporation. Applicant has discovered that use of a conforming layer 16, preferably flat, in the manner described maximizes surface contact to provide a substantially uniform pressure against the body of the user. In the preferred embodiment, layer 16 comprises four transverse regions 20*a*–20*d* of differing stiffnesses. The transverse regions are sized to correspond to the head and torso region, the hip region, the calf region, and the lower leg and foot. The foam comprising each transverse region has a stiffness selected to maximize the contact between the mattress and the user's body, and to exert a substantially uniform pressure against the user's skin. By so doing, the user is supported in such a way that the likelihood of tissue trauma and decubitus ulcers is minimized. In the preferred embodiment, regions 20*a* and 20*c* are formed of foams having a density of 5.7 lb/ft$^3$, and a ASTM D3574 tensile strength of 18.1 @ 20 in/min @ 22° C. Regions 20*b* and 20*d* are formed of foams having a density of 5.8 lb/ft$^3$, and a ASTM D3574 tensile strength of 14.6 @ 20 in/min @ 22° C. Suitable foam having the foregoing properties are available from EAR Specialty Composites, and are designated as CF 42 and CF 40, respectively.

Use of conforming foam according to the present invention provides increased contact area, and reduced overall pressure on the tissues. Applicant has also discovered however, that a mattress according to the present invention enables tissues to tolerate higher mean pressures than taught in the prior art. It is believed that this unanticipated, additional pressure tolerance of tissues supported according to the present invention is the result of reduced body shear.

It is widely appreciated lying or sitting compresses the supporting tissues. In addition, however, the tissue is also subjected to shear forces when the compressed tissue is deformed outwardly. This shearing action further traumatizes the tissue, and renders it more susceptible to pressure sores. Highly resilient, non-conforming foam causes high levels of tissue deformation and high body shear forces. Applicant has discovered that the use of open cell, temperature softening, urethane foam according to the present invention provides the heretofore unappreciated benefit of reducing shear forces.

The foregoing description of the preferred embodiment is intended to be illustrative, and not exclusive. It is understood that those skilled in the art could modify the foregoing embodiment without departing from the scope and spirit of the following claims.

I claim:

1. A mattress for reducing the occurrence of decubitus ulcers comprising:

a first layer formed of a first foam material, the first foam material being conformable to a person's body responsive to increased temperature and pressure for exerting a uniform, non-shearing support of the person;

the first layer having a plurality of transverse regions, including a first region positioned to support the person's upper torso from the head to a mid-lumbar area, a second region positioned to support the person's lower lumbar gluteal/hip, thigh, knee and proximal legs, a third region positioned to support the person's calves, and a fourth region positioned to support the person's heels and feet;

each said transverse region having a stiffness selected to maximize the contact between said foam and the user's skin, and to exert a substantially uniform pressure against the skin of the person; and said first and third regions having a density of about 5.7 $lb/ft^3$ and an ASTM® D3574 tensile strength of about 18.1 @ 20 in/minute @ 22° C.; and said second and third regions having a density of about 5.8 $lb/ft^3$ and an ASTM® D3574 tensile strength of about 14.6 @ 20 in/minute @ 22° C.;

respective second and third abrasion resistant foam layers engaged with a top and bottom surface of the first layer; and a fourth layer supporting the first layer, the fourth layer comprising a foam material having a convoluted upper surface.

2. A mattress according to claim 1 wherein said first layer comprises a temperature softening, open cell polyurethane foam.

3. A mattress for reducing the occurrence of decubitus ulcers comprising:

a first layer formed of a temperature softening, open cell polyurethane foam, the first layer conformable to a person's body responsive to increased temperature and pressure for exerting a uniform, non-shearing support of the person; the first layer having a plurality of transverse regions, including a first region positioned to support the person's upper torso from the head to a mid-lumbar area, a second region positioned to support the person's lower lumbar gluteal/hip, thigh, knee and proximal legs, a third region positioned to support the person's calves, and a fourth region positioned to support the person's feet;

each said transverse region having a stiffness selected to maximize the contact between said foam and the user's skin, and to exert a substantially uniform pressure against the skin of the person; said first and third regions having a density of about 5.7 $lb/ft^3$ and an ASTM® D3574 tensile strength of about 18.1 @ 20 in/minute @ 22° C.; said second and third regions having a density of about 5.8 $lb/ft^3$ and an ASTM® D3574 tensile strength of about 14.6 @ 20 in/minute @ 22° C.;

respective second and third abrasion resistant foam layers engaged with a top and bottom surface of the first layer;

a fourth layer supporting the first layer, the fourth layer comprising a foam material and having a convoluted upper surface.

* * * * *